US007070167B1

(12) United States Patent
Bacon et al.

(10) Patent No.: US 7,070,167 B1
(45) Date of Patent: Jul. 4, 2006

(54) LOW PROFILE LIFT APPARATUS WITH ONE TO ONE DIRECT LIFTING RATIO

(75) Inventors: Todd J. Bacon, Northville, MI (US); Richard A. Robb, West Bloomfield, MI (US)

(73) Assignee: Herkules Equipment Corporation, Walled Lake, MI (US)

( * ) Notice: Subject to any disclaimer, the term of this patent is extended or adjusted under 35 U.S.C. 154(b) by 189 days.

(21) Appl. No.: 10/754,163

(22) Filed: Jan. 10, 2004

Related U.S. Application Data

(60) Provisional application No. 60/439,839, filed on Jan. 14, 2003.

(51) Int. Cl.
*B66F 3/24* (2006.01)

(52) U.S. Cl. ..... 254/93 HP; 254/10 C

(58) Field of Classification Search ..... 254/93 HP, 254/10 R, 10 B, 10 C
See application file for complete search history.

(56) References Cited

U.S. PATENT DOCUMENTS 4,560,145 A * 12/1985 Widmer ..... 254/93 HP
6,871,364 B1 * 3/2005 Leoutsakos ..... 254/93 HP

* cited by examiner

*Primary Examiner*—Robert C. Watson

(57) ABSTRACT

A lifting apparatus comprising: one of a mobile/or and stationary base; a lift platform having a geometric first center, the lift platform movable relative to the base from a lowered position to an upper position; a linkage or linkage mechanism interconnecting the base and the lift platform for guiding the base and the lift platform to stay in a generally mutually parallel relationship as the lift platform moves relative to the base; the base, lift platform and linkage configured so that when the lift platform in its lowered position the first center intersects the base at a first point and with the lift platform in its upper position the first center intersects the base at a longitudinally off-set second point; and a fluid (fluid/pneumatic) control spring operatively mounted between the lift platform and the base, for controllably lifting and lowering the lift platform.

29 Claims, 13 Drawing Sheets

LOW PROFILE LIFT APPARATUS WITH ONE TO ONE DIRECT LIFTING RATIO

This application claims the benefit of U.S. Provisional Application 60/439,839, filed on Jan. 14, 2003. The disclosure of the above application is incorporated herein by reference.

BACKGROUND AND SUMMARY OF THE INVENTION

The present invention relates to a lifting apparatus and a more particularly to a lifting apparatus having a lift platform movable by a pneumatically inflatable spring, air bag, balloon, cushion, hydraulic cylinder, air cylinder or air bellows.

Lift platforms are used to raise and lower various items. In some cases the lift platform is used to lift a person(s) to a level which makes it easier for the person to perform his or her tasks. In other applications a part(s) or other object is placed on the lift platform and the lift platform raises or lowers the height of the part in relation to the operator. By moving the operator(s) or the part(s) to more ergonomic work locations, the efficiency of the operator is increased, the time to complete a given task is generally reduced, and operator's health is maintained by minimizing stress and strain of the human body during the job task.

The prior art shows many differently configured hydraulic and pneumatic lift mechanisms. One such lift is shown in U.S. Pat. No. 3,994,474 and includes two parallel-configured sides plates moved by an air spring (air bag). U.S. Pat. No. 6,286,812 shows another lifting platform which uses a scissors-type of linkage which is movable by an inflatable bag.

The present invention is configured to move the lift platform in an essentially parallel manner relative to the base without using scissors or folding linkages (as shown in the prior art) while employing a lift mechanism movable in a generally upward direction to minimize the force needed to lift an object, part or person. Experience has shown this approach also reduces the cost of the lift apparatus in relation to scissor lifting mechanism. The present invention utilizes a one-to-one direct, vertical lift ratio which provides an improved system. In the context of an air spring a one-to-one direct lifting ratio relates to the way in which the air spring dynamic load force vectors are applied during the lifting cycle such that for every unit of measure the lift platform raises during the lifting cycle the air spring travels the same unit of measure. The vertical loads are transferred directly through the air spring to the floor level or support structure.

One of the advantages of the present invention is the lift (and its components) can be lowered to an very low profile (and subsequently raised) which accommodates a wider range of operator statures to enable, where desired, to place the platform so the work piece is in the neutral posture range of the human body commonly referred to as the knuckle-to-elbow range.

One embodiment of the present invention uses a lift mechanism in the form of a parallelogram linkage which is moved by an air spring. The top of the air spring is fixed to the underside of the lift platform and by virtue of the flexibility of the air spring and the parallelism of the linkage, the air spring is able to follow the longitudinal movement of the platform.

It is an object of the present invention to provide to a lift platform with improved ergonomically characteristics which permit an increase in operator efficiency and a decrease in operator injury.

Accordingly the invention comprises: a lifting apparatus comprising: one of a mobile or stationary base; a lift platform having a geometric first center, the lift platform movable relative to the base from a lowered position to an upper position; a linkage or linkage mechanism interconnecting the base and the lift platform for guiding the lift platform to remain in a generally mutually parallel relationship with the base. The base, lift platform and linkage are configured so that when the lift platform in its lowered position the center of the lift platform intersects the base at a first point and with the lift platform in its upper position the center intersects the base at a second point which is longitudinally off-set from the first point. The lifting apparatus also includes a fluid (in general liquid or pneumatic) spring operatively mounted between the lift platform and the base, for controllably lifting and lowering the lift platform. Single and multi-chambered air springs are described as well as two, three and four bar linkage mechanisms and various control mechanisms are provided to control the movement of the lift platform.

Many other objects and purposes of the invention will be clear from the following detailed description of the drawings.

DETAILED DESCRIPTION OF THE DRAWINGS

Figure 1:
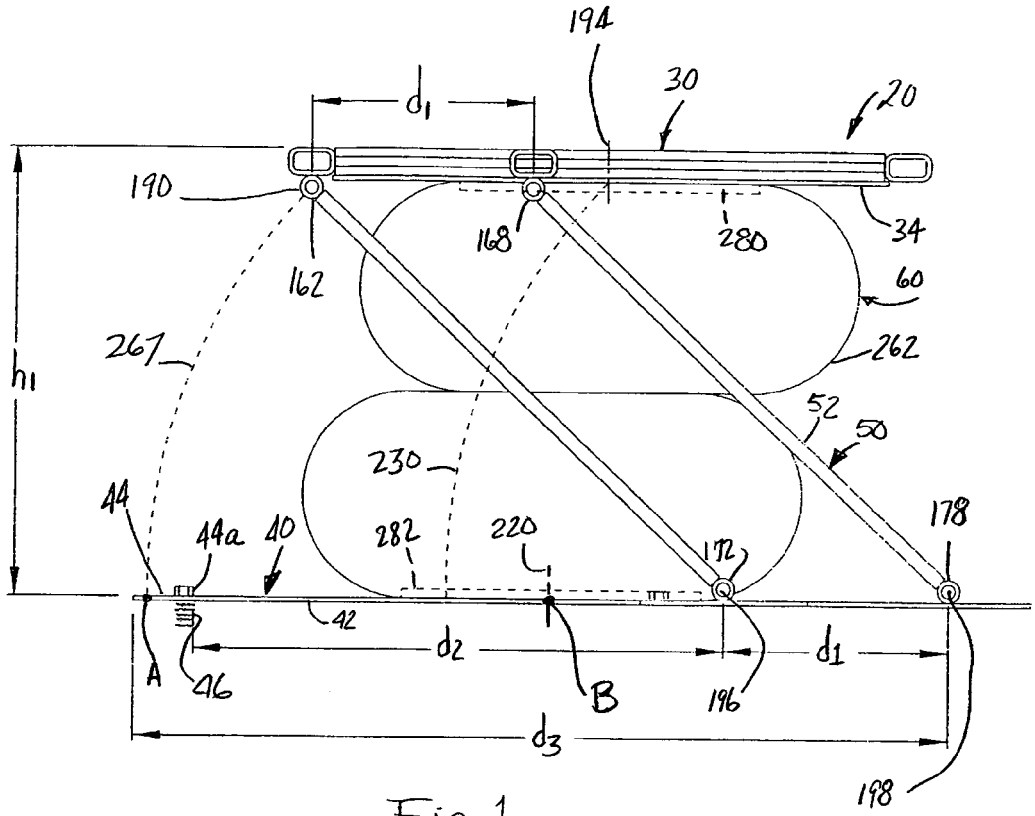
FIG. 1 is a side view of a lift apparatus in accordance with the present invention.

The reference is made to FIGS. 1 through 5 which illustrate a first embodiment of the present invention. More particularly, the figures illustrate to a lift apparatus 20 comprising a lift platform 30, and a support structure 40 having a base 42. The lift platform 30 and the support structure 40 are connected by a linking or stabilizing mechanism (linkage) 50. To the lift platform 30 and the support structure 40 are also connected by a lift spring which in the preferred embodiment is an inflatable device 60 which moves the platform 30 and linking or stabilizing mechanism 50 relative to the structure 40.

Figure 2:
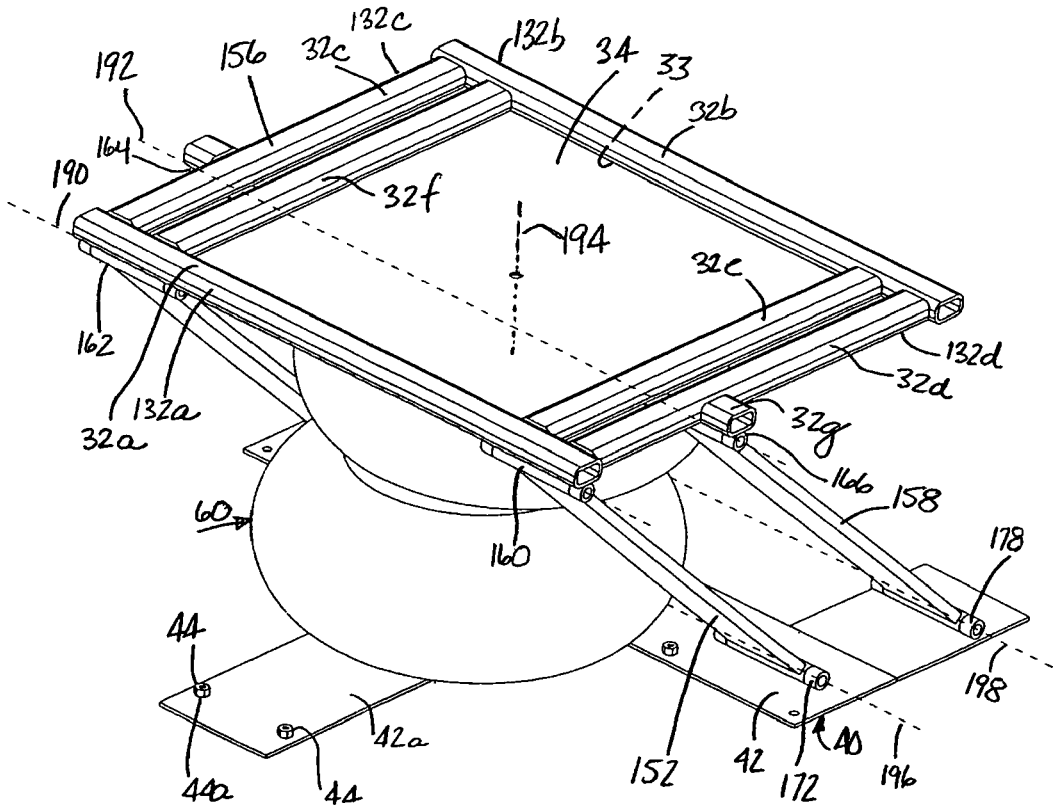
FIG. 2 illustrates and isometric view of the lift apparatus of FIG. 1.
Figure 3:
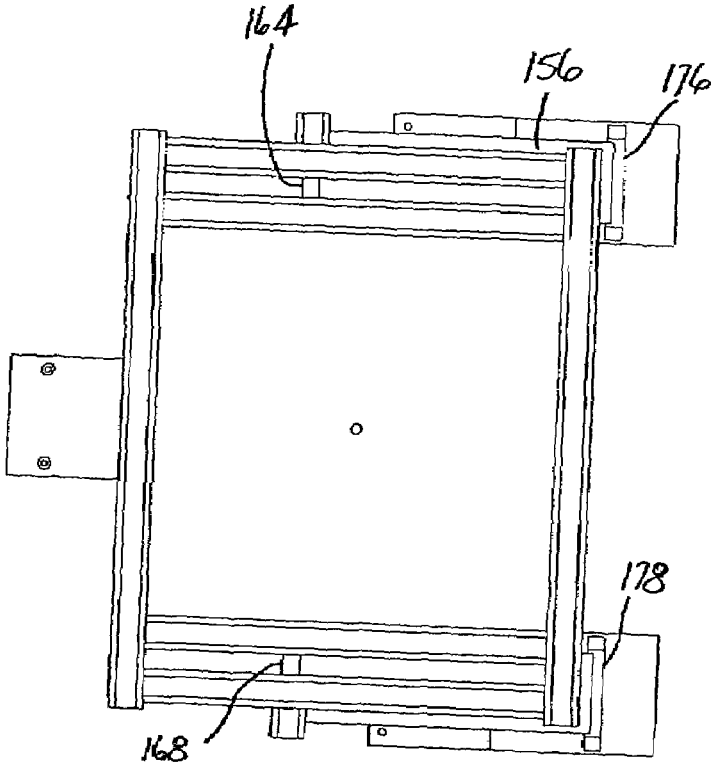
FIG. 3 is a top plan view of a lift apparatus.

In the preferred embodiment of the FIGS. 1–3 the lift platform 30 is made of a tubular steel (or steel plate) construction comprising a plurality of inter-connected to tubes, bars or ribs to 30*a* to 30*e*. The tubes or ribs may be hollow or solid. Tubes, bars or ribs 32*a* and 32*b* are arranged in opposing pairs and form sides 132*a* and 132*b* of the platform 30. Tubes, bars or ribs 32*c* and 32*b* form opposite sides 132*c* and 132*d* of the platform 30. Optional tubes, bars or ribs 32*e* and 32*f* can be used to reinforce the tubes (bars or ribs) 32*c* and 32*d*. As can be seen the tubes (bars or ribs) 32*a*–*f* form an open support with an opening 33. The opening 33 can be closed by a plate 34 (or tubing or railing) which is secured to the bottom of the tubes. Those parts used to close or at least fill in the opening 33 can also be secured to the top of the tubes (bars or ribs) as well.

As can be appreciated the use of thin wall tubes (bars, ribs) will reduce the weight of the platform. Alternatively, the tubes or ribs can be replaced by a plate of appropriately material (such as steel, plastic, etc.). For example, a solid thickness of material or a plate of a honeycombed construction can be use.

Figure 4:
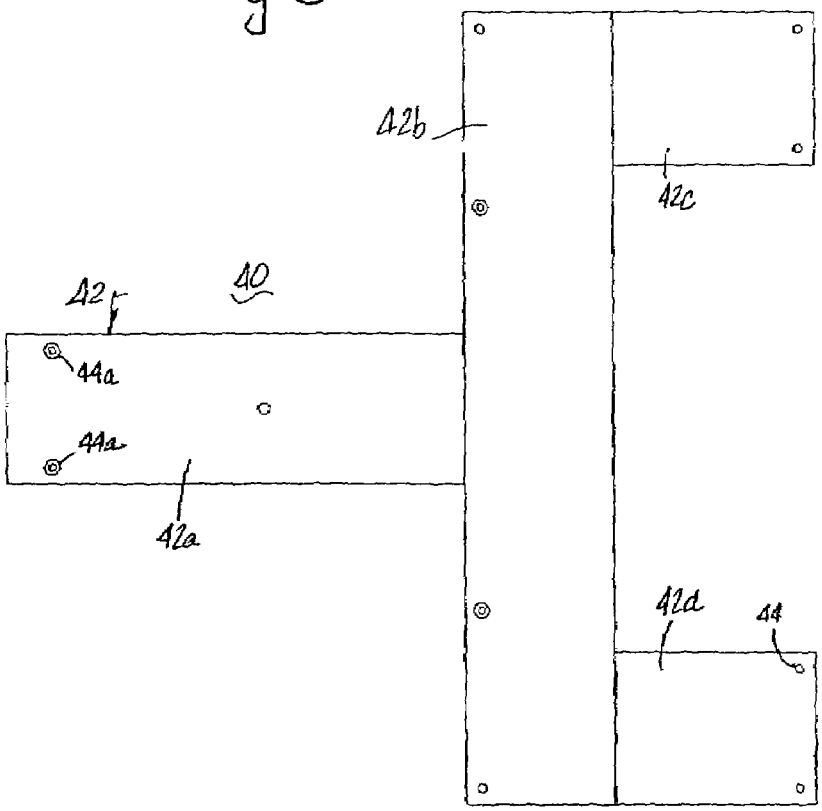
FIG. 4 it is a diagrammatic top view of a base support structure.

The base 42 comprises a plurality of inter-connected flat plates 42*a*–42*d*. Alternatively a large size plate with cut-outs can be substituted to achieve a unitary construction. The plate or plates 42*a*–42*d* can be connected together such as by welding. FIG. 4 is an isolated view of the base 42 and plates 42*a*–*d*. The base 42 can be configured to be permanently mounted or mounted to a movable fixture 41 such as one having wheels or coasters 43 as shown in FIG. 1*b* in contrast to FIG. 1 which shows the base 42 secured to an adjacent floor 46. To achieve this mounting arrangement of FIG. 1, one or more the plates include a one or more openings 44 to receive a corresponding fastener 44*a* enabling the support structure 40 to be fastened (screwed, bolted, riveted) to the adjacent floor 46 (if desired). The fasteners 44*a* can be inserted through the openings 44 into the floor or alternatively the fasteners 44*a* can be pre-positioned to extend up from the floor 46 wherein the base 42 is placed about these pre-positioned fasteners. Another fastener such as a washer (not shown) is attached to the extending fastener thereby securing a corresponding plate to the floor. For example, a work object including a box which may include parts is positioned atop the platform 30.

The linkage or linkage mechanism 50 in the preferred embodiment comprises a plurality of bars 152–158 and top hinges 162, 164, 166 and 168 and bottom hinges 172, 174, 176 and 178 respectively configured as a parallelogram bar linkage. Other variants can be used with the present invention as illustrated in subsequent figures.

Figure 5:
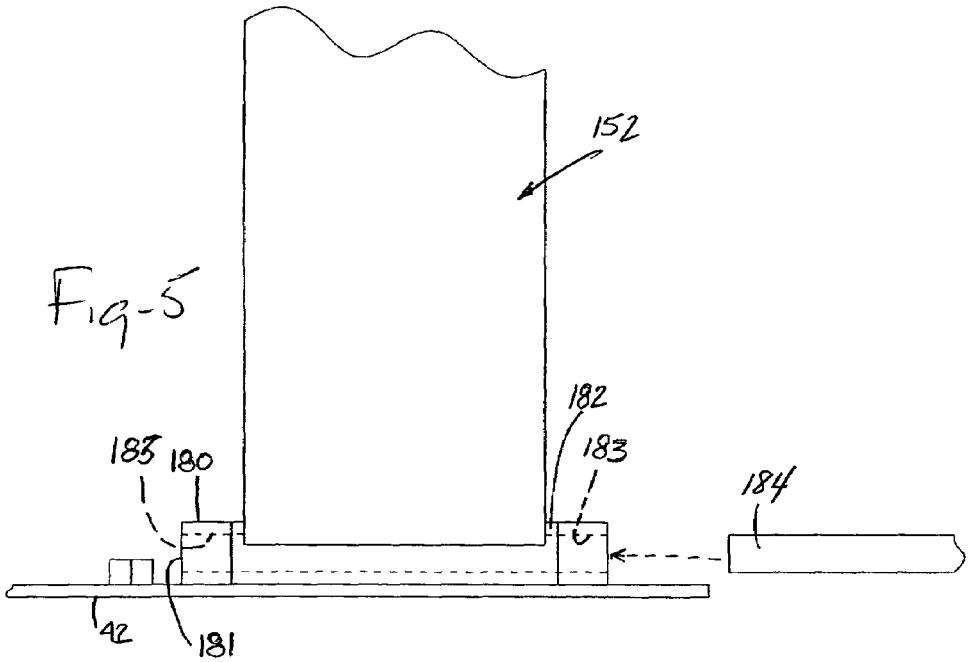
FIG. 5 shows an exemplary hinge configuration.

Reference is briefly made to FIG. 5 which illustrates en exemplary hinge 172 as well as the interconnection of bar 152, hinge 172 and the base 42. The relationship of the bars 152–158 to the top or upper hinges is the same or similar. The illustrated hinge/bar interconnection is relatively straightforward. Each hinge such as 172 comprises a tubular member 180 (opening 181) adapted to be fixedly secured to the base 42 (or platform 30 as the case may be) and another interfitting tubular member 182, with opening, slot or passage 183, fixed to or made as a part of an end of a bar such as 152 and which rotates with the bar. The tubular members 180 and 182 can be fixed to the base and to the platform by welding or other known techniques. Each hinge such as 172 further includes a pin 184 that interconnects the hinge parts 180 and 182 and provides a hinge or pivot axis and which fits within opening, slot or passage 143.

Reference is again made to FIGS. 1 and 2 which show axes 190, 192 and 194. Axis 190 runs along the underside of the platform 30 and defines the location of the upper hinges 162 and 164 which are located at outboard corners of the platform along axis 190. Axis 192 is displaced a distance $d_1$ away from axis 190 in a direction toward axis 194. Axis 194 extends through the geometric center of the lift platform 30. Hinges 166 and 168 are located on axis 194 at sides 132*c* and 132*d* of the platform 30. Hinge 166 is secured to the bottom of tubes 32*c* and 32*f* while hinge 168 is secured to the bottom of tubes 32*d* and 32*e*. To accommodate the length of both hinge parts 180 the platform may include shortened lengths of tubing 32*g* and 32*h* to which the upper hinges 166 and 168 are also secured.

FIG. 1 shows the lift platform 30 at its extended height h1. This orientation is useful in defining the location of the lower hinges 176 and 178 on the base. A lower hinge axis 196 (for hinges 172 and 174) is located in the base a distance $d_2$ away from and parallel to axis 190. A second lower hinge axis 198 (for hinges 176 and 178) is located in the base a distance $d_1$ behind and parallel to axis 196.

The bars 152–158 and hinge locations, in the preferred embodiment, are configured to minimize floor space as the lift platform 30 is raised and lowered as well as to provide and improved mechanical advantage.

Figure 6:
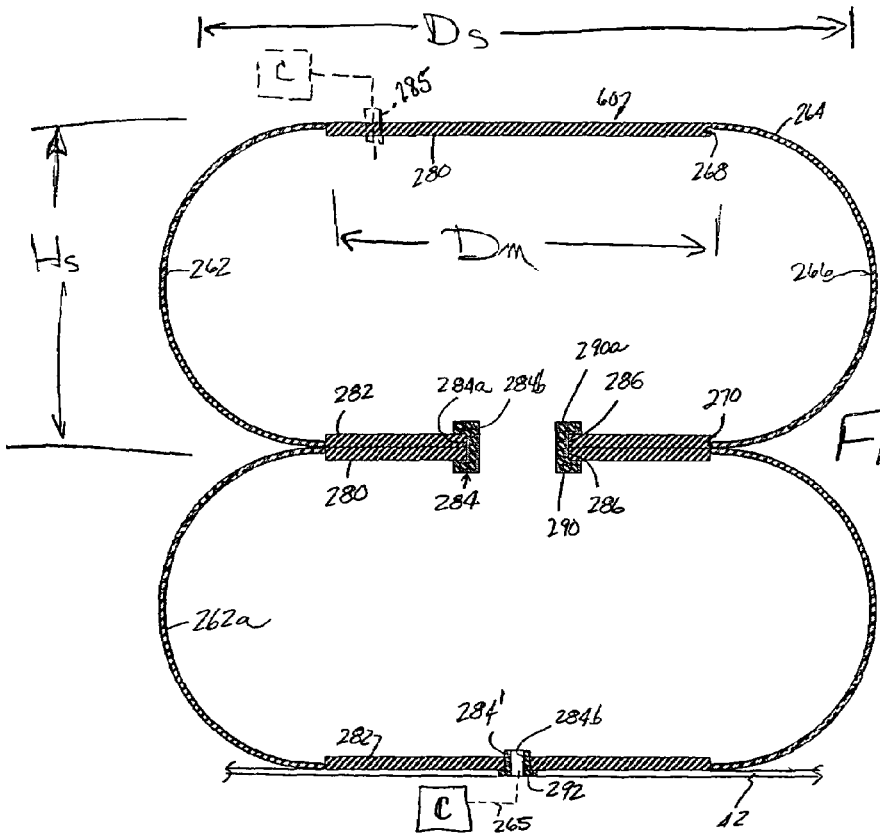
FIG. 6 is a cross-sectional view of an inflatable device using two air springs.

As mentioned above the apparatus 20 also includes a lift spring such as an inflatable lift device or mechanism 60. FIG. 6 shows further details of the one such lifting device. In the preferred embodiment the lift device 60 includes a plurality of interconnected inflatable springs 262, 262*a*. One such spring is made by Herkules Hebetechnik GmbH as part number 300-001. Each air spring can be made from a generally non-permeable material including an elastomer such as molded rubber, extruded film or sewn-together fabric or reinforced fabric construction depending on the environment and size of the objects to be placed on the lift. Each spring 262,262*a* includes a flexible side part formed as an, elastomeric ring 264 having a cylindrically shaped, flexible wall 266. The wall is configured to include an upper opening 268 and a lower opening 270. Each spring includes an upper, circular mounting plate 280 sealed in a fluid tight manner to the wall 266 (ring 262) about the upper opening 268. A lower, circular mounting plate 282 is also sealed in a fluid tight manner to the wall 266 at the lower opening 270.

As illustrated in FIG. 6 the present invention uses two interconnected springs 262 and 262*a* (configurations with more than two interconnected air springs are within the contemplation of the invention). The lower plate 282 of upper spring 262 and the upper plate 280 of the lower spring 262*a* each include an aligned opening 286 with interior threads. A, hollow, threaded the fastener 284 (having threads 284*a*) is received through the aligned openings 286 and secures the above plates together. The lower plate 282 of spring 262*a* can be secured to the base 42 in a similar way with another fastener 284*a*' of similar construction. Each fastener includes a central passage 284*b* to permit air flow therethrough.

In the preferred embodiment the diameter Ds of the inflated spring 262 is about 640 mm and the inflated height Hs is about 69 mm. The lowered height of the spring, at zero pressure is about 69 mm.

Figure 6A:
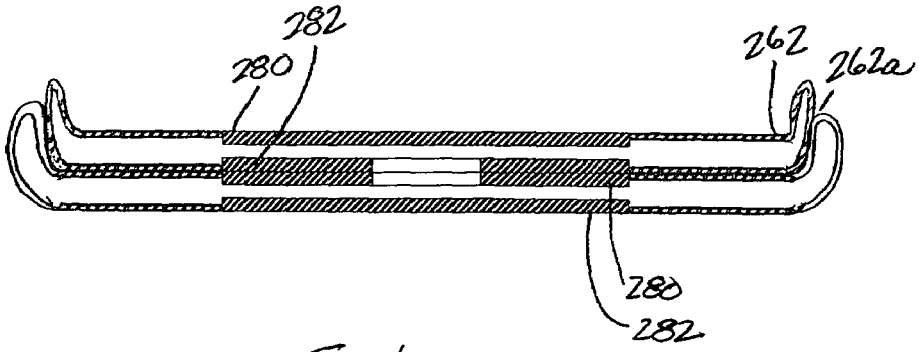
FIG. 6*a* shows a deflated air spring device.

The diameter Dm of the mounted plated 280 and 282 are about 510 mm. With these dimensions it has been found that the two inflatable springs 262 and 262*a*, when compressed and deflated will nest into one another as illustrated in FIG. 6*a*. One of the benefits of being able to nest the springs 262 and 262*a* is the platform can be lowered to about 100 mm cm above the base 42. FIG. 6 schematically shows a source of compressed air C, connected to the opening 284*b* in the lower of the fasteners 284' located through the base 42 (and lower plate 282). The air supply connection can be by way of discrete pressure lines 265 (flexible or stiff or solid) or for example of a pressure line or passage integrally formed in the base 42. FIG. 6 shows, in phantom line, an alternate connection of pressure line 265 communicating the source of pressure gas or fluid) C to the upper plate of air spring 262. As can be appreciated, pressurized fluid can be communicated to and through the wall of the spring 260 or 262*a* as schematically illustrated in phantom line by air connector 285.

Figure 1A:
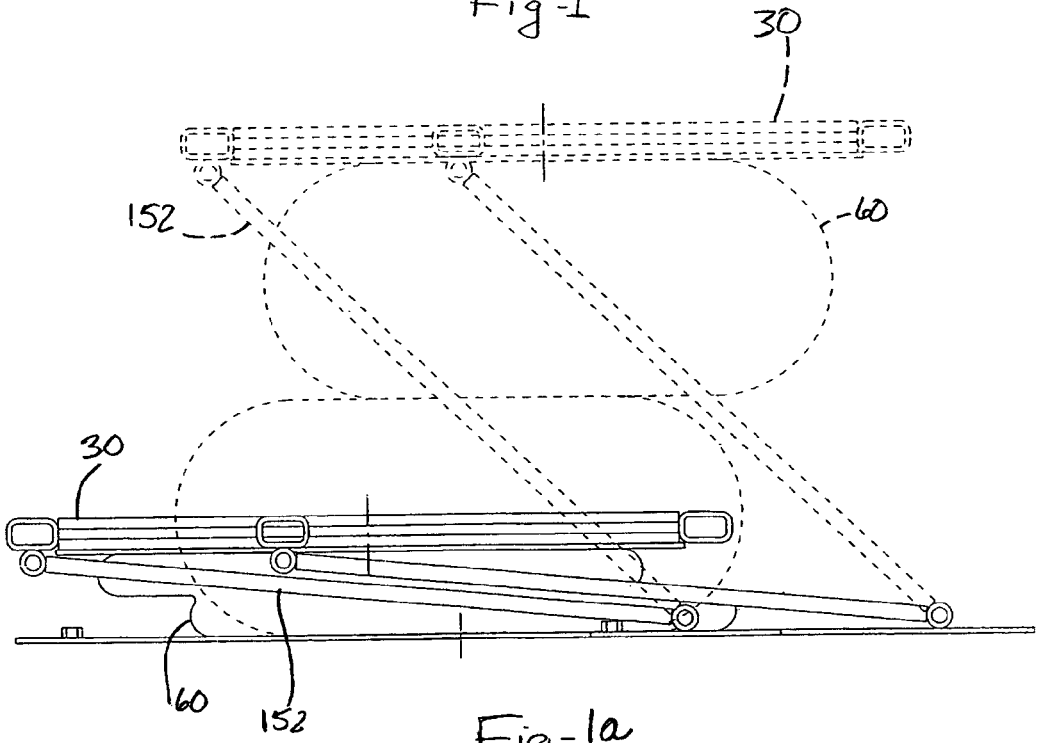
FIG. 1*a* shows a lift platform of the present invention in a lower position than shown in FIG. 1.
Figure 1B:
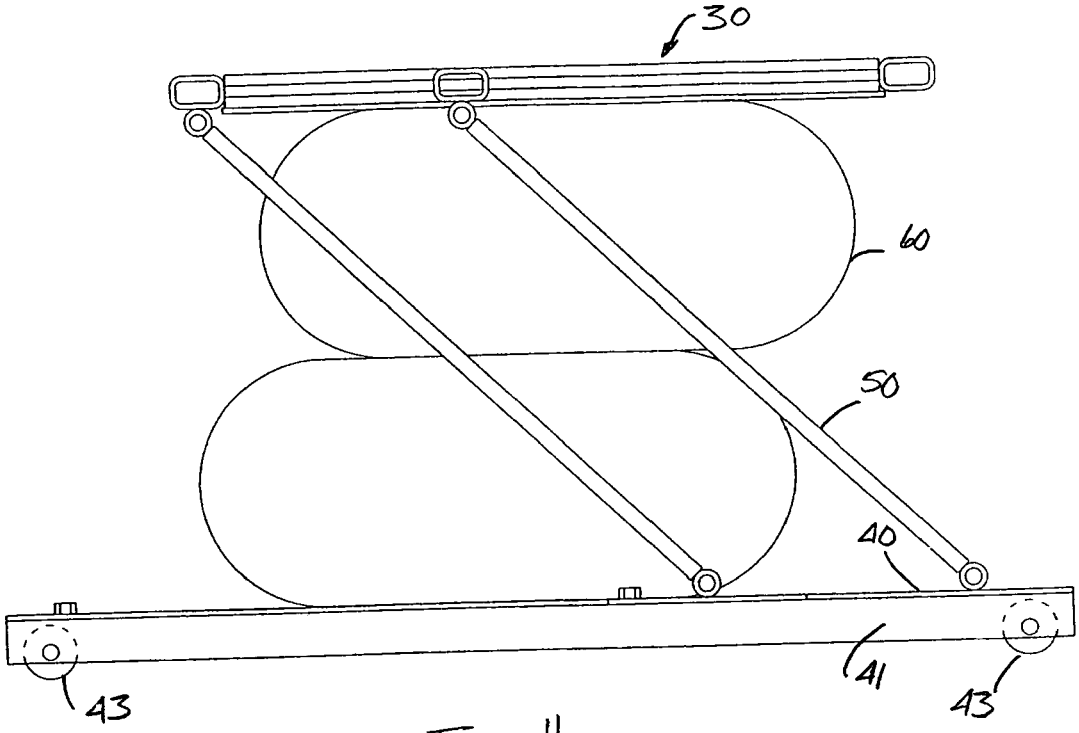
FIG. 1*b* shows an alternate embodiment of the invention with a movable base structure.

Reference is made to FIG. 1*a* which shows the platform 30 in a lowered condition. FIG. 1*a* also superimposes, in phantom line, the platform 30 (with some of the bars) in a raised condition for purpose of comparison. FIG. 1*a* shows a portion of spring 60 in its lowered or compressed configuration and FIG. 6*a* shows a cross-sectional view of the compressed spring 60.

Figure 6B:
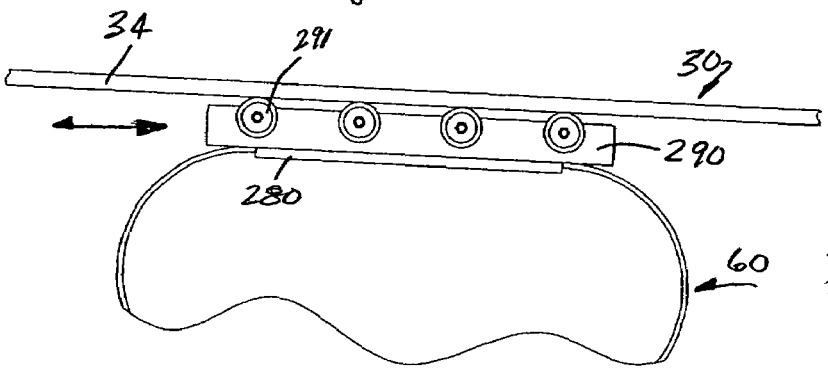
FIG. 6*b* shows an air spring with wheel slide connection to the platform.

The center of the upper plate 280 of spring 262 is located so its geometric center is below the geometric center of the platform 30 as defined by axis 194. In one embodiment of the invention the upper spring 262 is physically connected to the platform 30 (including being connected to plate 34) by bolting the plate 34 and the upper plate 280 together. It is also within the scope of the present invention that plate 280 of the upper spring 280 and the platform 30 and more particular the plate 34 are relatively movable one to the other. This can be achieved simply by permitting the upper plate 280 to press upwardly (devoid of a bolted or other fixed securement) on the lower surface of plate 34 and as the platform moves (vertically and longitudinally as defined by the linkage 50) the plate 34 and the spring plate 280 will slide, in a longitudinal direction (for example front-to-back) relative to one another. FIG. 6*b* shows a rudimentary wheel slide assembly 300 comprising a frame 290 and plurality of support wheels 291 fixed to plate 280 which slidingly support plate 34 of the lift platform 30.

Reference is made to point A of FIG. 1. Point A is used to define the location of the lower spring 262*a*. Point A is achieved conceptually by permitting the linkage 50 to completely rotated counter-clockwise which will effectively place the platform 30 on top of the support structure 40. In this position upper hinges 162 and 164 (as well as the entire platform 30) will move along an arc, see line 267, (defined by the length of bars 152 and 154 (the length of all of the bars is the same). Point A is essentially the intersection of the upper hinges with the structure 40. Distance d3 is the linear distance between point A and the lower hinge 178 (or 176) location. The lower spring 262*a*, that is, the center of the lower plate 282 of spring 262*a*, is located left-to-right generally about one-half the distance d3 and centered laterally below the upper spring 262 (see FIG. 6). Point B as well as axis 220 show the center of the lower spring 262*a*.

Reference is made to phantom line 230 which traces the trajectory (as visible in a side view) of the center of the lift platform 30, as can be appreciated as the lift platform 30 and the linkage 50 move up and down the center of the lift platform will follow this arc (which defines the longitudinal motion of the platform). If the top of the inflatable device 60 is hard-mounted to the platform 30 and the bottom of the inflatable device is also hard mounted to the support structure 40, the lift apparatus 60 must be sufficiently flexible so it can follow the relative movement of the lift platform 30. This relative movement of the inflatable device 60, in the preferred embodiment, is accomplished by using the low profile design of the Herkules air springs 262 and 262*a*. The relative movement can be accomplished with one air spring (see FIG. 6*c*) or a stack or plurality of springs (see FIG. 6*d*) or single cell springs shown in FIGS. 6*e* and 6*f*. This flexibility of the device 60 also assures the resultant upward force vector produced by the inflatable device 60 always acts vertically on the platform as well as acts on the platform providing an increased mechanical efficiency and direct one-to-one lift ratio.

Figure 6C:
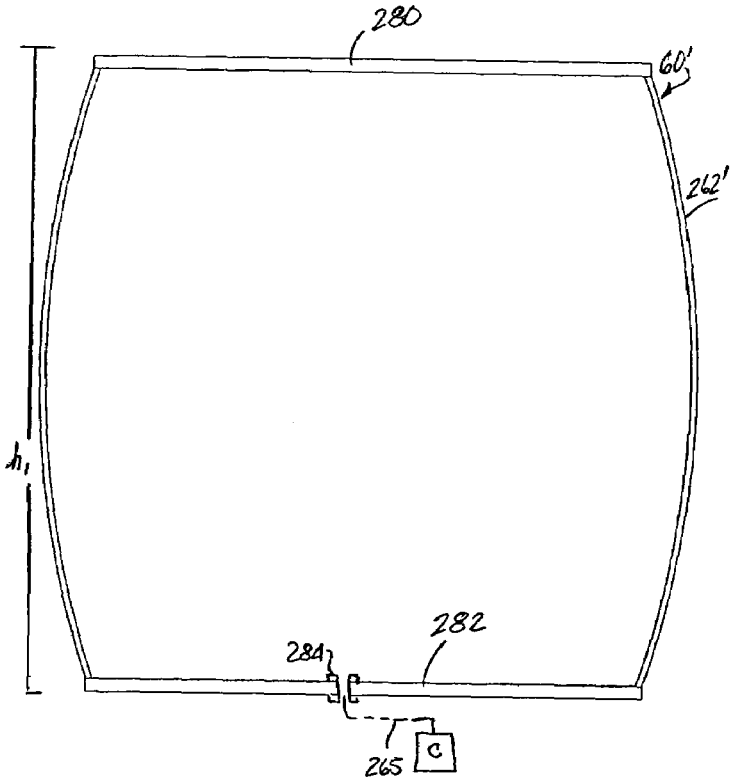
FIG. 6*c* shows an alternate embodiment of the present invention.
Figure 6D:
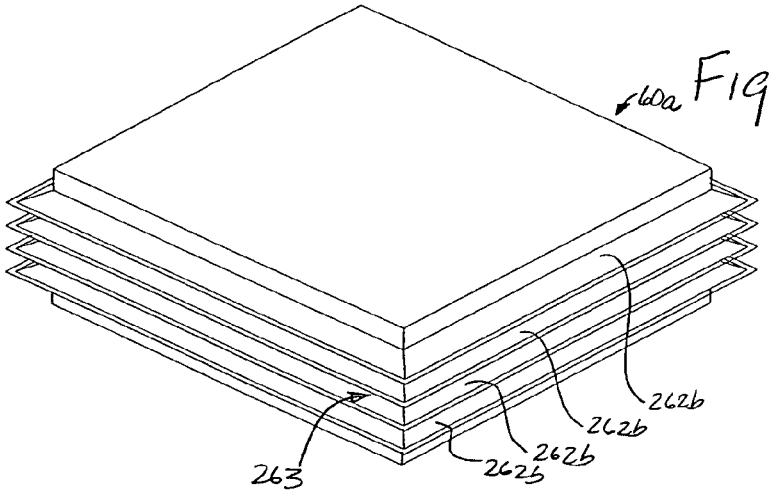
FIG. 6*d* shows a square air bellows.
Figure 6E:
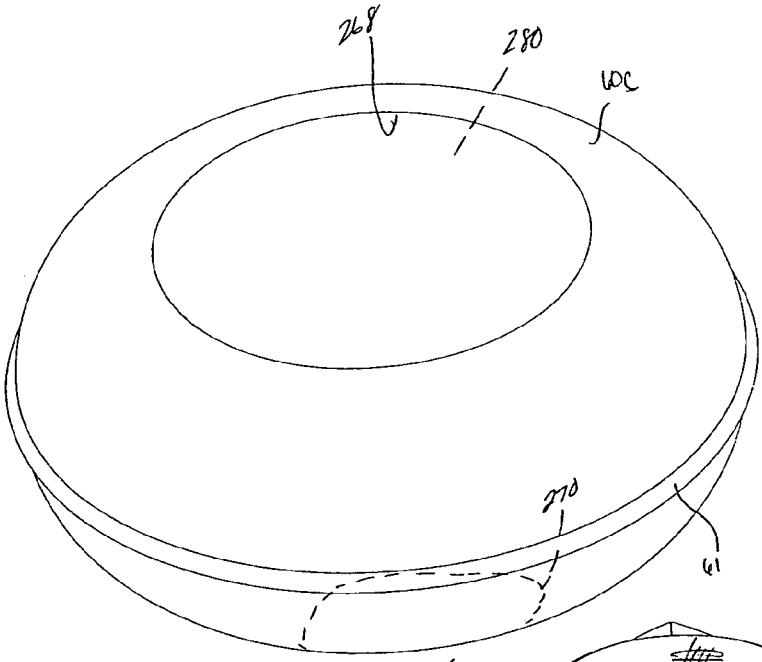
FIG. 6*e* shows a round air bellows, cloth, rubber or vinyl bag.

Reference is briefly made to FIG. 6*c* which diagrammatically shows an inflatable device 60' comprising a single chambered, cylindrical air spring 262'. The air spring 262' also uses the mounting plates 280 and 282. Lower plate 282 can be mounted to the base 42 (not shown) and to a source of compresses air C. Plate 280 would be mounted to the lift platform 30. As shown in FIG. 6*d*, the inflatable device 60*a* can be configured as a bellows with a plurality of accordion folds 262*b* formed along an exterior of the bellows such as along a rectangular side wall. FIG. 6*e* shows another embodiment of a single, circular-annular air spring 60*c* made in two halves of elastomeric material joined along a central or equatorial seam or bead 61. The spring includes a respective opening 268 and 270 on its top and bottom for received of a respective upper and lower plate 280 and or 282.

Figure 6F:
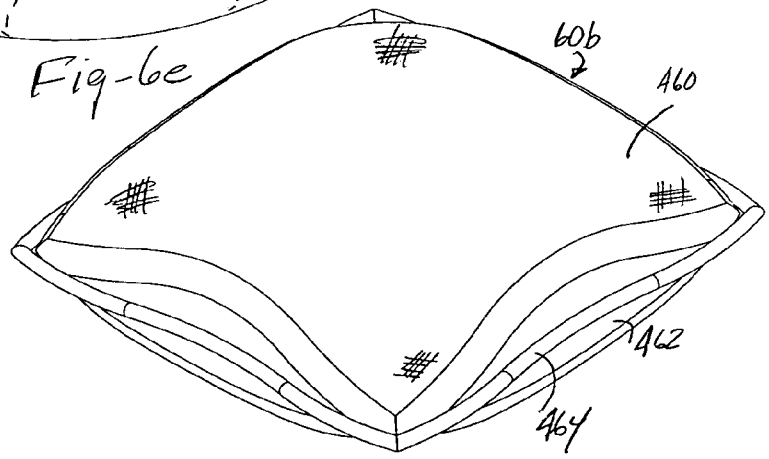
FIG. 6*f* shows an alternate pillow construction.

FIG. 6*f* shows another embodiment of the invention. In this embodiment the air spring 60*b* which includes two facing panels 460 and 462 of reinforced material joined sewn or bonded at a non-permeable seam 464. Such material can for example be a) a plastic film or b) woven fabric covered with a non-permeable coated such as silicon, neoprene or the like.

Figure 7:
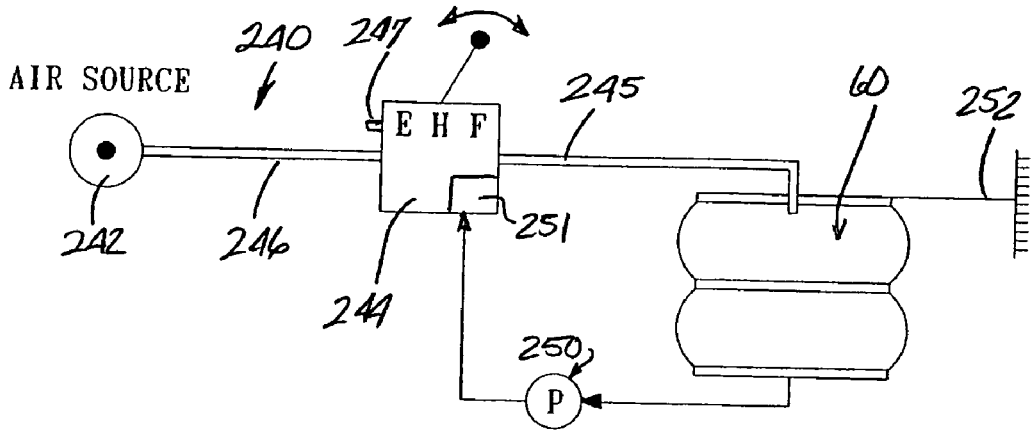
FIG. 7 diagrammatically shows an air control system.

Reference is made to FIG. 7 which diagrammatically shows a control system such as a manually controlled fluid valve 240 for inflating and deflating the device 60 (springs 262, 262*a*, 262'). The control system 240 includes a source of pressurized or compressed gas 242 which is communicated to a manually controllable air valve 244 via an air line 246. The valve 244 is communicated to an inlet of the lift device 60 through another air line 245 (in one of the ways mentioned above). The valve 244 is movable between positions corresponding to Fill (F), Hold (H), and Exhaust (E). With the valve 244 placed in the Fill position pressured air is received by the inflatable device 60 through air line 245 and the lift platform will be lifted to a new work position. When the operator has moved the platform to the new work position, the valve is moved to its Hold position in which the air pressure in the device 60 is maintained. The lift platform can be lowered if the valve 244 is moved to the Exhaust position which enables the inflation air within the device 60 to be released through exhaust port 247 and the platform lowered. A more sophisticated air control system can be achieved by adding a pressure sensor 250 which is connected in a closed loop manner (through a closed loop controller 251 in a known manner) can automatically control the internal pressure within the device 60. The controller 251 is diagrammatically shown in FIG. 7. Similarly, a height or position sensor 252 can be added in a closed loop manner and enables the lift platform to maintain a determinable height regardless of the loads placed on the lift platform 30. In a control loop control system a command pressure or command position such as the height of the platform is input to the controller 251 and the achieved pressure and or height signal is fed back to the controller 251 to generate an error signal which controls the inflatable device.

Figure 8:
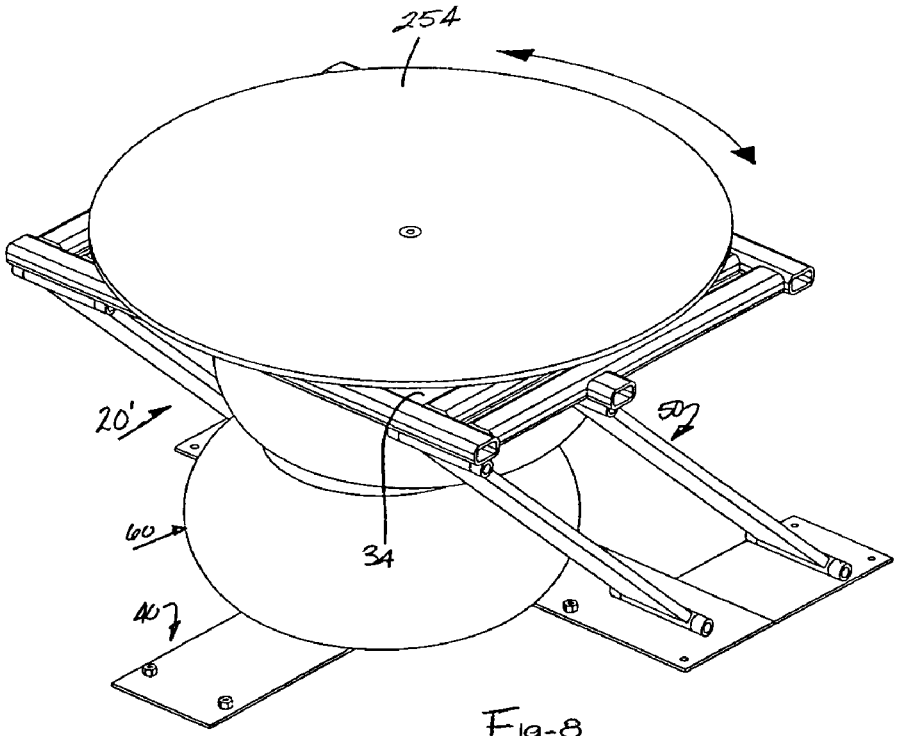
FIG. 8 is a view of another embodiment of the invention with a rotary platform.
Figure 9:
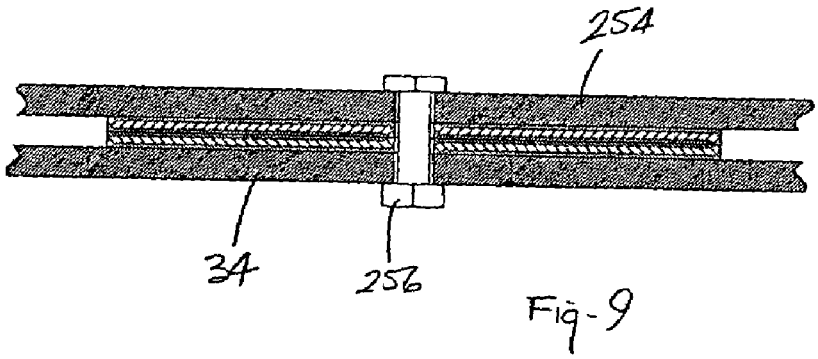
FIG. 9 shows a bushing or bearing for use with the embodiment of FIG. 8.

Reference is made to FIGS. 8 and 9 which shows another alternate of the present invention. The apparatus 20' of FIG. 8 is identical to apparatus 20 but includes an upper plate 254 which serves as a work table or upper platform. In the embodiment shown the dimension of plate 254 is about the same as lift platform 30 (or plate 34, if used, however, plate 254 can be over-sized extending considerably beyond the dimensions of the lift platform 30. FIG. 9 shows an exemplary rotary bearing or bushing 256 rotatably connecting the plates 254 and 34. In this embodiment the plat or platform 254 can be manually rotated by the operator to place to items thereon to a more convenient or ergonomic working position.

Figure 10:
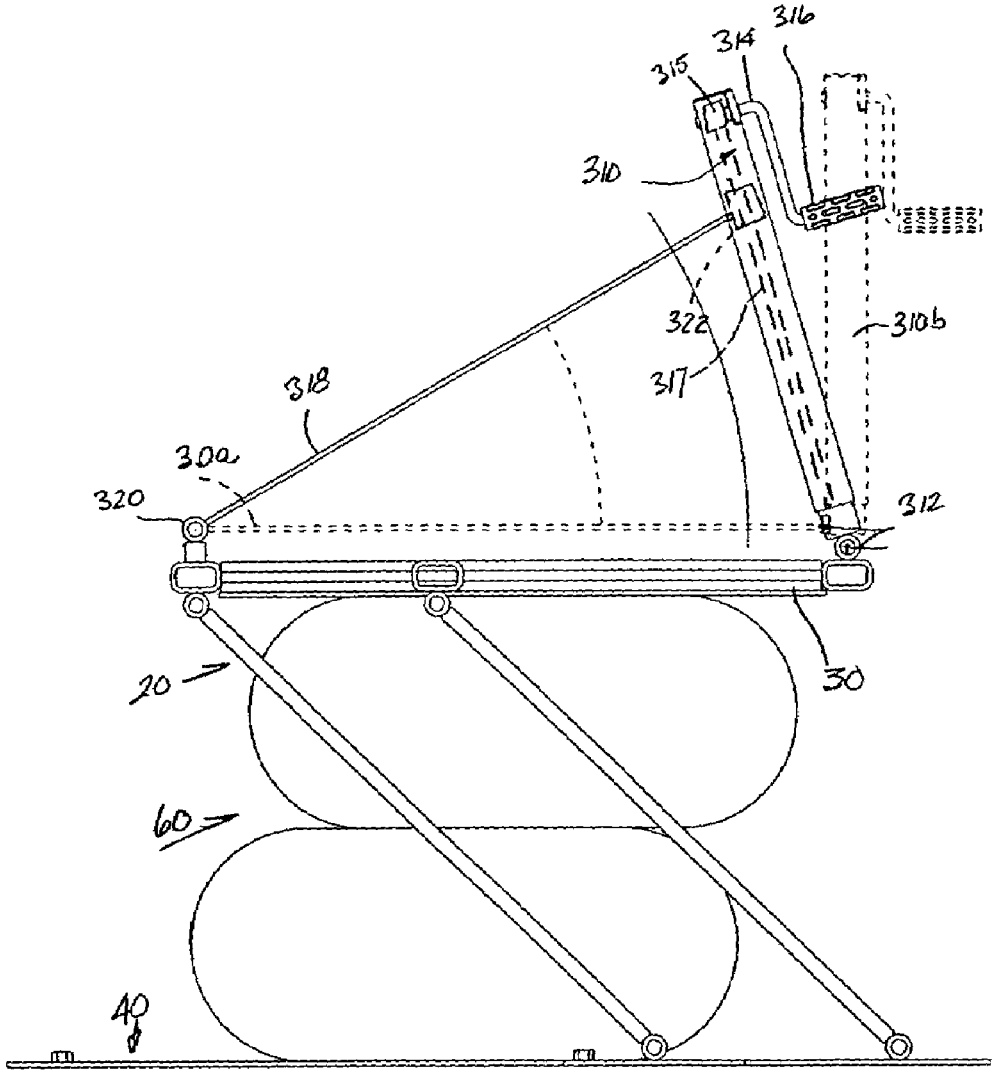
FIG. 10 is a side view of another embodiment of the invention with a tilt assembly.

Reference is made to FIG. 10 which illustrates an alternate embodiment of the invention. This embodiment also includes an additional plate of such as plate 310. Plate of 310 is attached to the lift apparatus 20 using one or more hinges 312. Plate 310 additionally includes a crank mechanism 314 which can be manual or automatic. The manual mechanism includes a crank handle 316 connected through a transmission 315 to a rotatable rod 317. Rotation of the rod 317 caused a block 322 to translate along the rod (in the manner of a worn gear mechanism). A rear support or link 318 (which extends from hinge 320) is connected to the movable block 322. As the handle crank is turned the plate 310 (in essence moves with block 322) and rotates from a lower position shown by phantom line 310*a* to a more up right position also shown in phantom line as 310*b*, which may vary between 0 and 90 degrees. One of the benefits of this type of system is work pieces secured to the rotatable plate 310 can be moved to more ergonomic positions.

Figure 11:
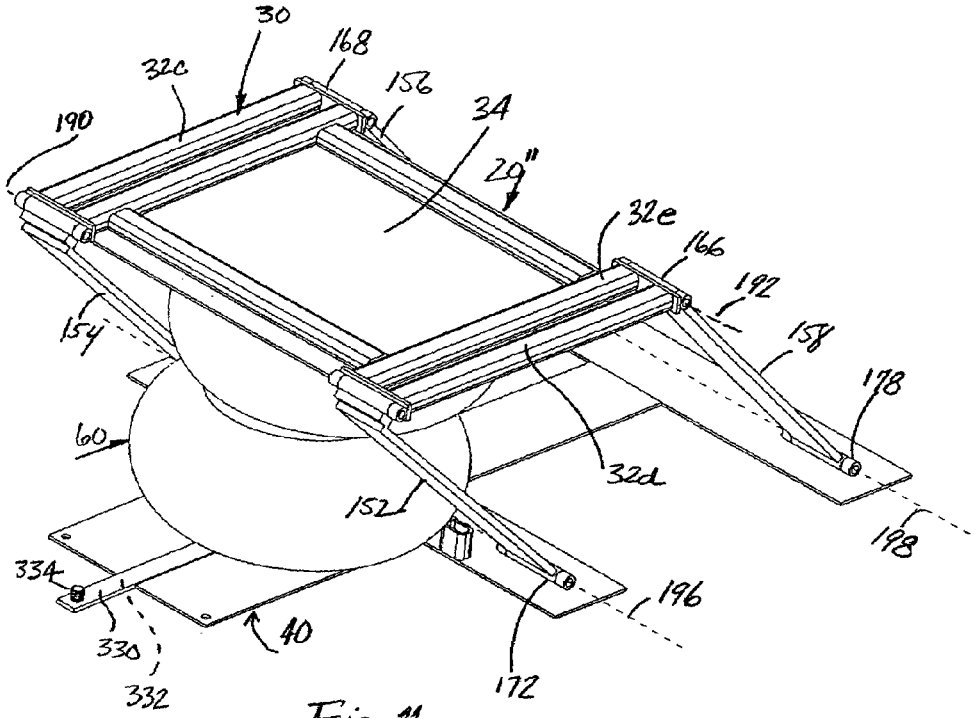
FIGS. 11–13 show another embodiment of the invention.
Figure 12:
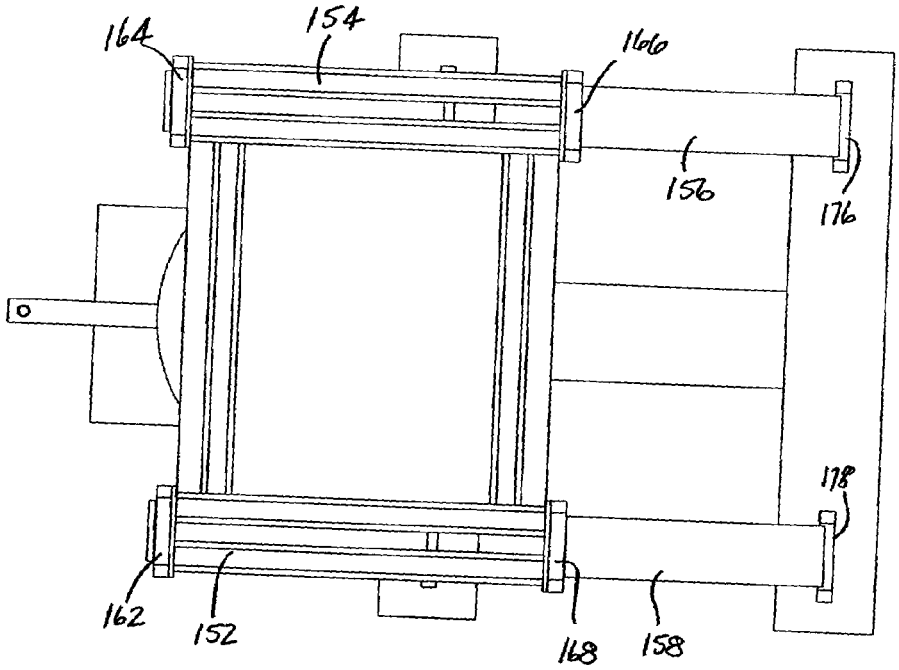
Figure 13:
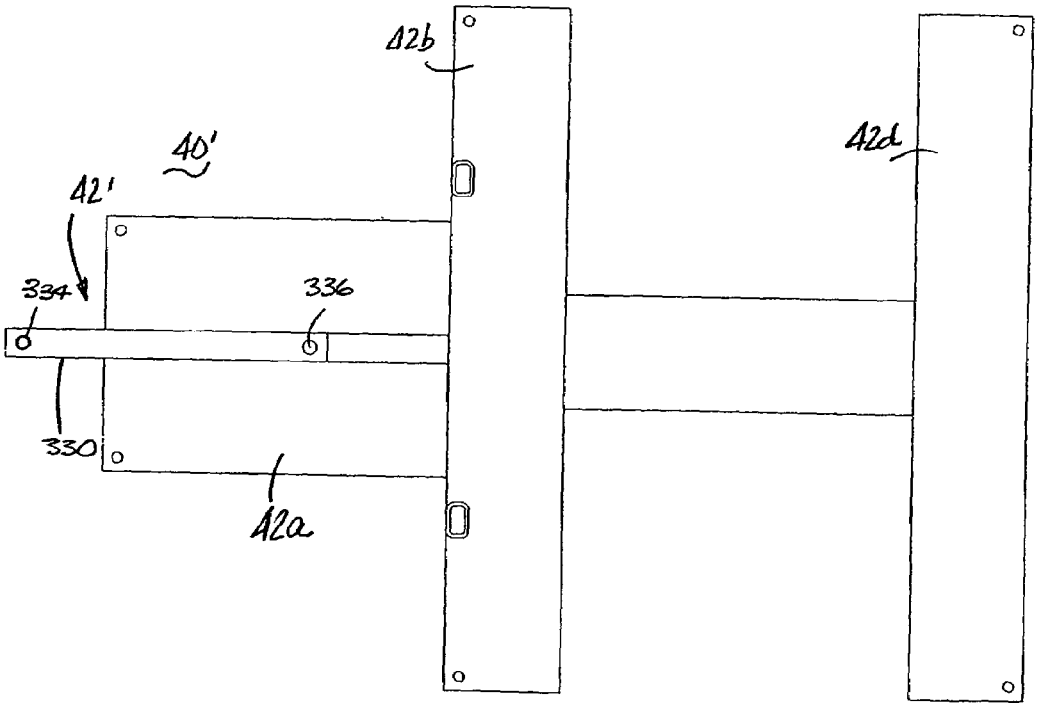

Reference is made to FIGS. 11–13 which show another embodiment of the invention. FIG. 11 is an isometric view of lift apparatus 20". FIG. 12 is a top view and FIG. 13 is a top view of the base 42' of the support platform 40'. The lift apparatus 20" incorporates many of the elements of apparatus 20, the major difference being the relative placement of the bars 156, 158, upper hinges 166, 168 and lower hinges 176, 178. Tubes, bars or ribs 32*a* and 32*b* are placed interior to the cross-bars 32*e* and 32*f* and the hinges 166 and 168 have been moved to the remote ends of tubes 32*c,f* and 32*e,d* respectively. Axis 192 is shown, as before extending between the upper hinges 166 and 168. Axis 198 which defines the location of the complementary lower hinges 176 and 178 has been moved a like distance to maintaining the parallelism of the four bars 152, 154, 156 and 158. As can be seen in FIG. 13 the base plates 42*a–d* are arranged differently than in FIG. 4 but are still configured to be placed on the work floor. The fasteners 44*a* can be placed in any or all of the various plates 42*a–d*. FIG. 13 also shows a bar 330 which extends into the center of the lower air spring 262*a*. The bar 330 is hollow and functions as high speed and secure air passage 332 comprising of a thin wall tubing with a rectangular cross-section. Numeral 334 illustrates an air fitting to which an air hose can be connected. Numeral the 336 (see FIG. 13) shows an exit port located beneath the air bag spring 262*a* through which air is communicated to the air spring.

Figure 14:
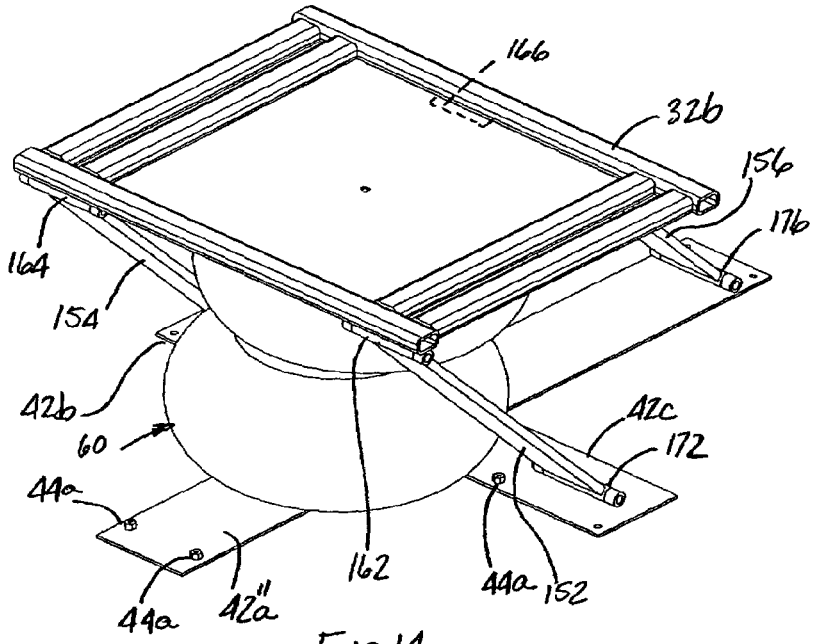
FIGS. 14–16 show another embodiment of the invention.
Figure 15:
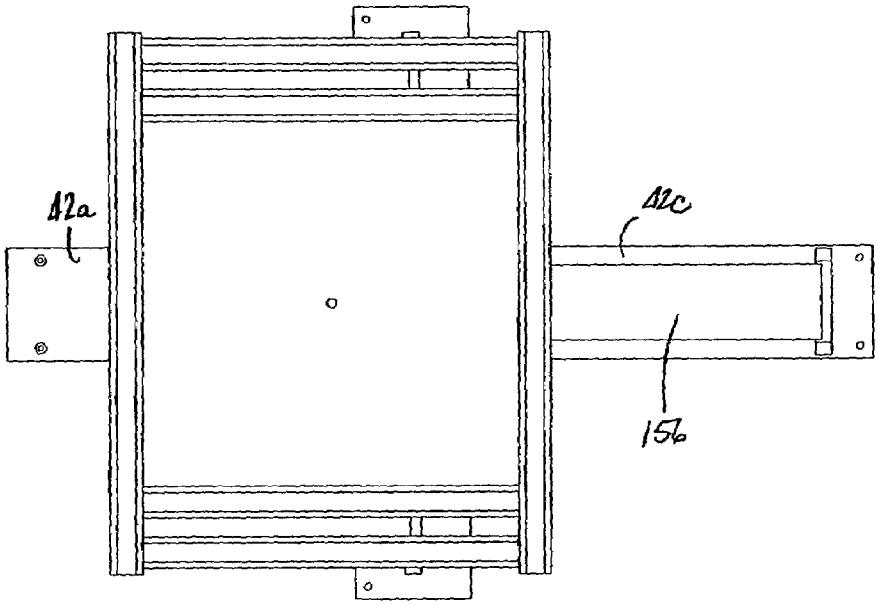
Figure 16:
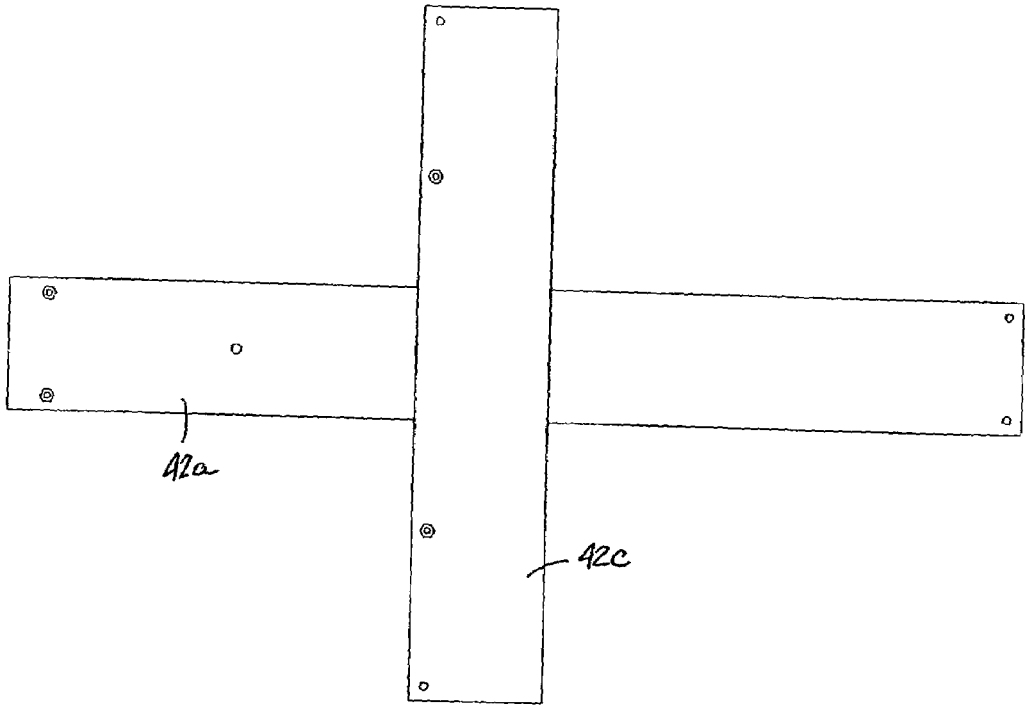

FIGS. 14–16 shown another variation of the present invention. The basic difference in comparison to the embodiment of FIG. 11 is that bar 158, upper hinge 168 and lower hinge 178 have been removed and upper hinge 166 has been moved to the center of tube 32*b*. Bar 156 and lower hinge 176 extend from the upper hinge to maintain the parallelism with the other bars 152 and 154. The base 42*a*" is made of fewer plates than is base 42'. Hinge 176 is secured to a remote end of base plate 42*a*".

Figure 17:
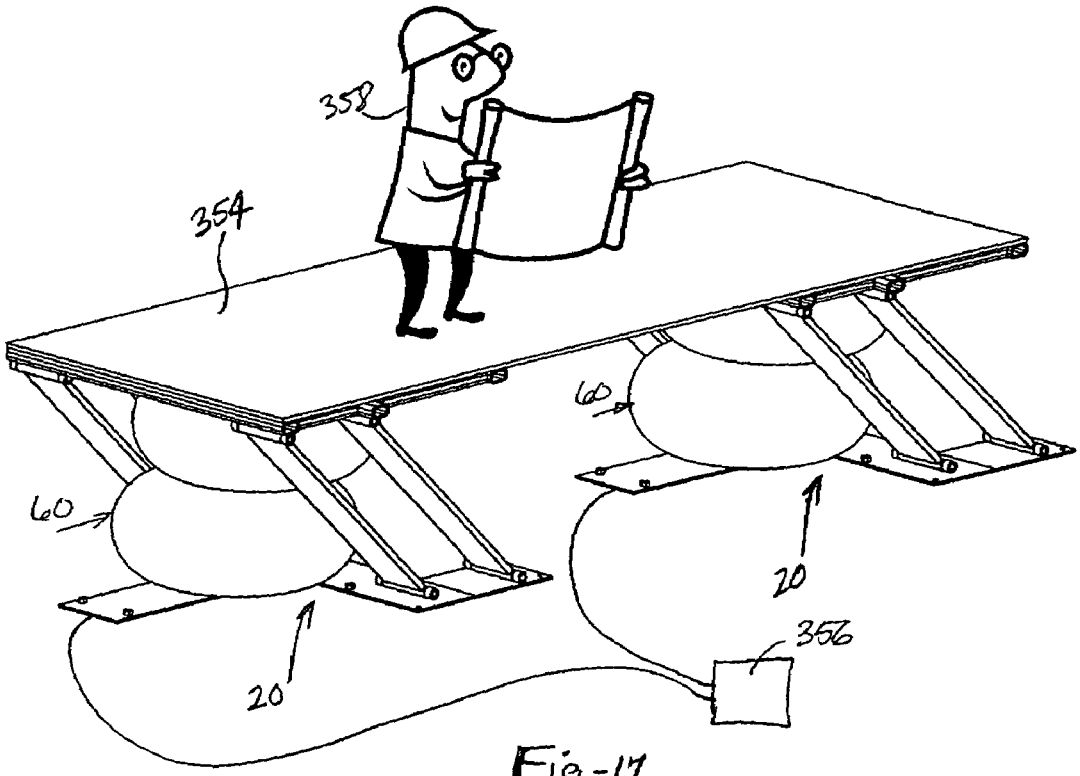
FIGS. 17–20 show other embodiments of the invention for lifting humans, for lifting boxes, an embodiment using a protective skirting to prevent operator injury and other embodiment configured as an automotive lift

FIG. 17 shows yet another embodiment of the present invention. In this embodiment two identical lift mechanisms 20 (20',20") are positioned relative to one another. A large rectangular platform 354 bridges the distance between the lift mechanisms 20. Pneumatic air lines for each air spring 60 extend from a common pneumatic controller 356. In this configuration platform 354 can be raised and lower in a horizontal configuration. In this embodiment in the platform 354 his raised and lower to move a worker 358 relative to his workstation (not shown).

Figure 18:
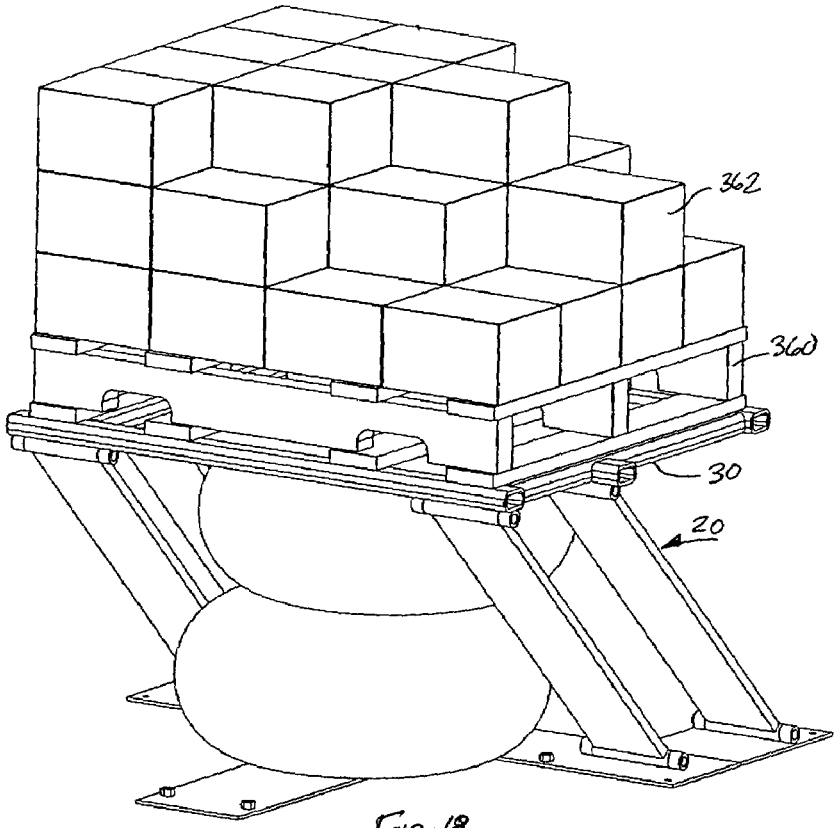

FIG. 18 illustrates another embodiment which is usable with each of the lift mechanisms described above. In this embodiment a palette 360 has been positioned on the lift platform 30. A plurality of boxes (generally stackable parts 362) are stacked upon the palette 360 and movable vertically.

Figure 19:
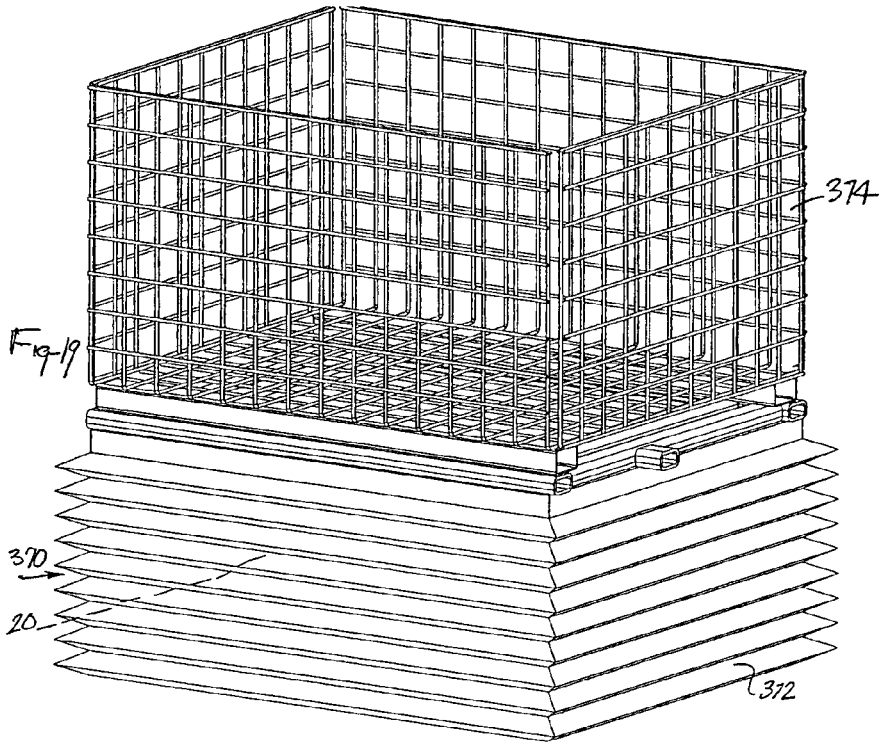

FIG. 19 shows another variant of the present invention. In this embodiment a protective housing is generally shown as 370 located about any of the lift mechanism 20, 20', etc discussed above. The housing includes with a flexible bellows shaped skirting 372 formed with a plurality of accordion pleats. The skirting moves up and down with the movement of the lift mechanism. For the purpose of illustration, to show the usefully of the present invention an open wire frame storage box 374 has been placed upon the lift mechanism.

Figure 20:
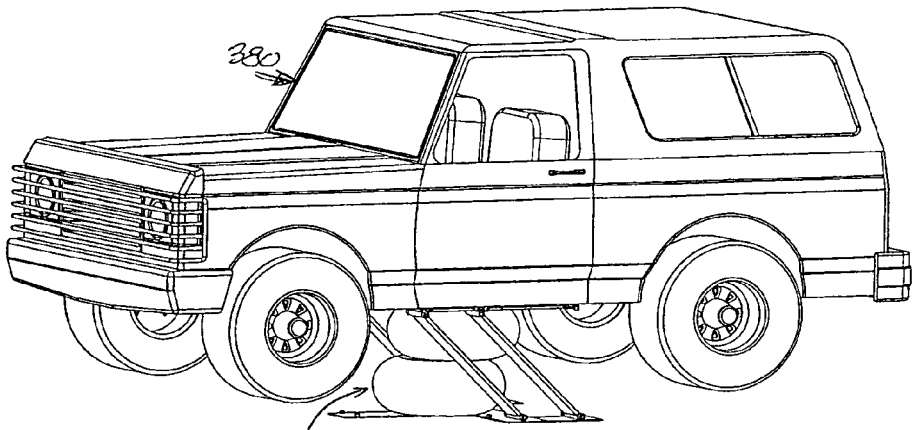

FIG. 20 illustrates a lift mechanism 20 positioned below a vehicle 380. The lift mechanism 20 is configured as a jacket or vertical hoist for this vehicle 380.

Many changes and modifications in the above-described embodiment of the invention can, of course, be carried out without departing from the scope thereof. Accordingly, that scope is intended to be limited only by the scope of the appended claims.

The invention claimed is:

1. A lifting apparatus (20) comprising:

one of a mobile and stationary support structure or base (40; 42);

a lift platform (30) having a geometric first center (32), the lift platform movable relative to the base from a lowered position to an upper position;

a linkage (50) interconnecting the base and the lift platform for guiding the base and the lift platform to stay in a generally mutually parallel relationship as the lift platform moves relative to the base;

lift means, operatively mounted between the lift platform and the base, for controllably lifting and lowering the lift platform between the lowered and upper position, the lift means comprising a pneumatically inflatable device (60) having at least a first or lower member lower and an adjacent and operatively connected second or upper member, the inflatable members configured to move vertically and horizontally relatively to one another, and when in the lowered position the second or upper inflatable member is offset in a first direction relative to the first or lower inflatable member, and when in the upper position, the second or upper inflatable member is offset from the first or lower inflatable member in an opposite direction.

2. The apparatus as defined in claim 1 wherein the inflatable device includes a top, having a top center, and a bottom, having a bottom center, wherein when the lift platform is lowered an axis extending through the top and bottom centers is off-set in one direction and with the lift platform in a raised condition the axis is off-set in an opposite longitudinal direction.

3. The apparatus as defined in claim 1 wherein the pneumatically inflatable device includes an inflatable toroidally shaped first member (262*a*) and an inflatable toroidally shaped second member (262) mounted in fluid communication with the first member.

4. The apparatus as defined in claim 3 wherein the toroidal first and second members are configured so that when they are uninflated at least a portion of the second member fits within the first member while another portion of the second member extends beyond the first member, in the direction of the off-set and when the members are inflated, the second member is positioned atop the first member.

5. The apparatus as defined in claim 3 wherein a bottom (282) of the first member (262*a*) is secured to the base (42) and wherein a top (280) of the second member (262) is one of fixedly and slidably secured to the lift platform (30).

6. The apparatus as define in claim 3 wherein an axis which extends through the center of the inflatable second member is coincident with the first center of the lift platform.

7. The apparatus as define in claim 3 wherein an axis which extends through the center of the inflatable first member is longitudinally off-set relative to the second point.

8. The apparatus as defined in claim 1 wherein the linkage (50), which guides the lift platform (50) relative to the base, includes a plurality of bars (152–158) each of which are rotatably mounted relative to the base and the lift platform and configured to operate in the manner of a parallelogram linkage.

9. The apparatus as defined in claim 8 wherein a first bar extends from an upper first hinge located near a first end of a first side of the lift platform to a lower first hinge on the base, a second bar extends from an upper second hinge located near a second end of the first side of the lift platform to a lower second hinge on the base.

10. The apparatus as defined in claim 9 wherein the linkage further includes:

a third bar extending from an upper third hinge located in between the first end and third end of the lift platform to a lower third hinge on the base, the upper first and third hinges and the lower first and third hinges configured to lie in a predetermined plane.

11. The apparatus as defined in claim 9 wherein the inflatable device is located in between the first and the second bars.

12. The apparatus as defined in claim 9 wherein the inflatable device is located within a spaced defined by the range of movement of the first, second and third bars.

13. The apparatus as defined in claim 10 wherein the linkage further includes:

a fourth bar extending from an upper fourth hinge located in between the first end and fourth end of the lift platform to a lower fourth hinge on the base, the upper second and fourth hinges and the lower second and fourth hinges configured to lay in a predetermined plane.

14. The apparatus as defined in claim 10 wherein the linkage further includes:

a third bar extending from an upper third hinge, located spaced from an axis joining the first and second upper hinges, to a lower third hinge on the base, the first second and third upper first and third hinges and the lower first and third hinges configured to lay in a predetermined plane.

15. A lifting apparatus comprising:

one of a mobile and stationary base;

a lift platform having a geometric first center, the lift platform movable relative to the base from a lowered position to an upper position;

a linkage interconnecting the base and the lift platform for guiding the base and the lift platform to stay in a generally mutually parallel relationship as the lift platform moves relative to the base;

a pneumatically inflatable device having a flexible and laterally displaceable side wall, the inflatable device configured so one of its top, side, axis and wall(s) is one of a) off-set in one direction from its bottom with the lift platform lowered and b) off-set in another direction with the lift platform raised.

16. The apparatus as defined in claim 15 wherein the inflatable device operates directly on the platform and the base.

17. The apparatus as defined in claim 15 wherein the pneumatically inflatable device includes only two inflatable portions, the first inflatable portion being a toroidally shaped first member and the second inflatable portion being a toroidally shaped second member mounted to the first member.

18. The apparatus as defined in claim 17 wherein the first and second members are configured so that when uninflated, at least a portion of the second member fits within the first member while another portion of the second member extends beyond the first member, in the direction of the off-set and when the members are inflated, the second member is positioned generally atop the first member.

19. The apparatus as defined in claim 17 wherein a bottom of the first member is secured to the base and wherein a top of the second member is one of fixedly and slidably secured to the lift platform.

20. The apparatus as defined in claim 15 wherein the linkage is configured as a parallelogram linkage and hinged to an underside of the lift platform.

21. The apparatus as defined in claim 15 wherein the linkage is configured as one of a two, three and four bar parallel configured linkage.

22. A lifting apparatus comprising:

one of a mobile and stationary base;

a lift platform movable relative to the base from a lowered position to an upper position;

a linkage interconnecting the base and the lift platform for guiding the base and the lift platform to stay in a generally mutually parallel relationship as the lift platform moves relative to the base;

an air spring mechanism mounted below the lift platform and to exert a force thereon to controllably raise and lower the platform between a lowered and a raised position, the air spring configured as an inflatable chamber formed by two inflatable members, an upper and a lower annular inflatable member operatively connected together, the upper and lower inflatable members each configured to be in a deflated condition when the platform is in a lowered position with the upper member collapse and off-set in at least one dimension relative the lower member.

23. The apparatus as defined in claim 22 wherein the air spring includes a pneumatically inflatable device (60) having a flexible and laterally displaceable side wall(s) (266).

24. The apparatus as defined in claim 22 wherein the air spring means includes a pneumatically inflatable device having a laterally displaceable side wall which moves longitudinally in concert with the movement of the lift platform.

25. The apparatus as defined in claim 23 wherein the air spring device includes a top, having a top center, and a bottom, having a bottom center, wherein when the lift platform is lowered an axis extending through the top and bottom centers is off-set in one direction and with the lift platform in a raised condition the axis is off-set in an opposite longitudinal direction.

26. The apparatus as defined in claim 22 wherein the toroidal first and second members are configured so that when they are uninflated at least a portion of the second member fits within the first member while another portion of the second member extends beyond the first member, in the direction of the off-set and when the members are inflated, the second member is positioned atop the first member.

27. The apparatus as defined in claim 8 wherein those bars that are rotationally mounted to the lift platform pivot about two spaced axes, and wherein each of the axes are off-set to a side of an axis that extends through the geometric center of the lift platform.

28. The apparatus as defined in claim 1 wherein the lift platform comprises a plurality of tubes configured to form opposing sides and opposing ends of the lift platform.

29. The apparatus as defined in claim 28 further including a plate positioned upon the tubes.

* * * * *